US010386138B2

(12) United States Patent
Nuss et al.

(10) Patent No.: US 10,386,138 B2
(45) **Date of Patent: *Aug. 20, 2019**

(54) INTERCHANGEABLE PLATES FOR A FIREARM

(71) Applicant: Magpul Industries Corp., Austin, TX (US)

(72) Inventors: Felix Nuss, Arvada, CO (US); Yehezkel Eitan, Johnstown, CO (US)

(73) Assignee: Magpul Industries Corp., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/022,246

(22) Filed: Jun. 28, 2018

(65) Prior Publication Data

US 2019/0162494 A1 May 30, 2019

Related U.S. Application Data

(63) Continuation of application No. 15/824,161, filed on Nov. 28, 2017, now Pat. No. 10,036,602.

(51) Int. Cl.
*F41A 3/66* (2006.01)
*F41A 35/06* (2006.01)
(Continued)

(52) U.S. Cl.
CPC *F41A 3/66* (2013.01); *F41A 3/22* (2013.01); *F41A 3/72* (2013.01); *F41A 35/06* (2013.01); *F41C 23/02* (2013.01); *F41C 33/007* (2013.01)

(58) Field of Classification Search
CPC .. F41A 35/06; F41A 35/02; F41A 3/66; F41A 3/22; F41A 3/72; F41A 11/00; F41A 11/02; F41A 15/12
See application file for complete search history.

(56) References Cited

U.S. PATENT DOCUMENTS 3,341,963 A * 9/1967 Seiderman ..... F41A 3/20 42/16
3,380,182 A 4/1968 Browning
(Continued)

FOREIGN PATENT DOCUMENTS

DE 19940999 A1 3/2001
DE 102004029205 B3 2/2006
(Continued)

OTHER PUBLICATIONS

Accuracy International, "AICS Chassis Systems", "Retrieved from http://www.accuracyinternational.us/aics-chassis-systems/", May 15, 2017.

(Continued)

*Primary Examiner* — Derrick R Morgan
(74) *Attorney, Agent, or Firm* — Neugeboren O'Dowd PC

(57) ABSTRACT

A firearm and related methods and components are disclosed. The firearm has a chassis, a stock portion coupled to the chassis, and a pair of interchangeable plates removably coupled to the chassis. Each of the pair of interchangeable plates is attachable to the chassis at a first location and a second location opposing the first location. A first one of the pair of interchangeable plates has a recess for receiving a portion of a bolt handle. A second one of the pair of interchangeable plates has a firearm tool interface.

15 Claims, 17 Drawing Sheets

(51) Int. Cl.

| | |
|---|---|
| ***F41A 3/22*** | (2006.01) |
| ***F41A 3/72*** | (2006.01) |
| *F41C 23/02* | (2006.01) |
| *F41C 33/00* | (2006.01) |

(56) References Cited

U.S. PATENT DOCUMENTS 3,791,060 A * 2/1974 Weaver ..... F41A 3/72 42/16
5,669,169 A * 9/1997 Schmitter ..... F41A 3/66 42/75.01
5,813,158 A 9/1998 Campbell et al.
5,970,642 A 10/1999 Martin
6,487,805 B1 12/2002 Reynolds
6,508,025 B1 * 1/2003 Du Plessis ..... F41A 15/12 42/16
6,591,533 B2 7/2003 Wygant
6,658,781 B1 12/2003 Bowen
6,662,485 B2 12/2003 Kay
6,688,031 B2 2/2004 Steele
6,820,533 B2 11/2004 Schuerman
6,886,286 B2 5/2005 Dowding
6,889,461 B2 5/2005 Vignaroli et al.
7,325,351 B1 2/2008 Leung
7,418,797 B1 9/2008 Crose
7,428,794 B2 9/2008 Oz
7,454,858 B2 11/2008 Griffin
7,467,489 B2 12/2008 Beretta
7,506,469 B2 3/2009 Poulin et al.
7,536,819 B2 5/2009 Popikow
7,552,557 B1 6/2009 Mabry
7,578,089 B1 8/2009 Griffin
7,640,688 B2 1/2010 Oz
7,673,412 B2 3/2010 Griffin
7,698,847 B2 4/2010 Griffin
7,698,848 B1 4/2010 Bentley
7,726,060 B1 * 6/2010 Jones ..... F41A 3/66 42/75.02
7,748,154 B2 7/2010 Moretti
7,793,453 B1 9/2010 Sewell, Jr. et al.
7,802,392 B2 9/2010 Peterson et al.
7,827,719 B2 11/2010 McGarry
7,827,721 B2 11/2010 Griffin
7,841,119 B1 * 11/2010 Boyd ..... F41C 23/20 42/71.01
7,930,849 B2 4/2011 Abraham et al.
7,937,875 B1 5/2011 Berg
7,938,055 B2 5/2011 Hochstrate et al.
7,966,761 B1 6/2011 Kuczynko et al.
7,984,580 B1 7/2011 Giauque et al.
8,028,458 B2 10/2011 Rohrauer
8,056,277 B2 11/2011 Griffin
8,087,193 B2 1/2012 Kincel
8,127,483 B2 3/2012 Kincel
8,215,047 B2 7/2012 Ash, Jr. et al.
8,245,428 B2 8/2012 Griffin
8,307,575 B1 * 11/2012 Battaglia ..... F41A 3/64 42/75.03
8,312,661 B2 11/2012 Ludlow
8,327,569 B2 12/2012 Kincel
8,387,298 B2 3/2013 Kincel
8,393,104 B1 3/2013 Moody et al.
8,429,844 B2 4/2013 Dextraze et al.
8,464,458 B2 6/2013 Chvala
8,601,734 B1 12/2013 Hopkins et al.
8,631,601 B2 1/2014 Langevin et al.
8,656,622 B2 2/2014 Peterson et al.
8,656,623 B1 2/2014 Chvala
8,720,099 B1 5/2014 Sisk
8,752,323 B2 6/2014 Fulton et al.
8,769,855 B2 7/2014 Law
8,826,797 B2 * 9/2014 Overstreet ..... F41A 35/06 89/128
8,844,185 B2 9/2014 Jarboe
8,857,094 B2 10/2014 Michel
8,904,692 B2 12/2014 Ballard
8,915,005 B2 12/2014 Grimshaw et al.
8,931,137 B2 1/2015 Daniel et al.
8,955,245 B2 2/2015 Chvala
9,010,008 B2 4/2015 Hovey
9,015,980 B2 4/2015 Shull
9,021,734 B2 5/2015 Voigt
D731,023 S 6/2015 Hirt et al.
9,234,722 B2 1/2016 Rice et al.
9,341,429 B1 5/2016 Reavis, III
9,389,044 B2 7/2016 Rice et al.
9,417,033 B2 8/2016 Wood et al.
9,448,034 B2 9/2016 Downey et al.
9,464,863 B2 10/2016 Mather et al.
9,546,845 B2 1/2017 Mather
9,599,429 B1 3/2017 Davis
9,612,082 B2 4/2017 Cottle
9,612,083 B2 4/2017 Cottle et al.
9,664,479 B1 5/2017 Robinson et al.
9,927,202 B2 * 3/2018 Ives ..... F41A 3/22
10,036,602 B1 7/2018 Nuss et al.
2003/0029070 A1 2/2003 Dowding
2003/0051385 A1 3/2003 Wygant
2005/0235546 A1 * 10/2005 Wonisch ..... F41A 3/12 42/75.01
2005/0241211 A1 11/2005 Swan
2006/0010749 A1 1/2006 Kincel
2006/0174532 A1 8/2006 Popikow
2008/0028662 A1 2/2008 Abraham et al.
2010/0212201 A1 * 8/2010 Kincel ..... F41G 11/003 42/2
2011/0047850 A1 3/2011 Rievley et al.
2012/0137561 A1 6/2012 Ludlow
2012/0174451 A1 * 7/2012 Overstreet ..... F41A 3/12 42/16
2013/0091751 A1 4/2013 Barney
2013/0185895 A1 7/2013 Daniel et al.
2013/0340312 A1 12/2013 Fulton et al.
2014/0196345 A1 7/2014 Grimshaw et al.
2014/0196346 A1 7/2014 Grimshaw et al.
2015/0176945 A1 6/2015 Simek
2015/0233656 A1 * 8/2015 Karagias ..... F41C 23/04 42/16
2016/0025448 A1 1/2016 Kincel
2016/0084612 A1 3/2016 Robinson et al.
2016/0116250 A1 4/2016 Mather
2016/0178309 A1 * 6/2016 Drake ..... F41A 35/06 42/14
2016/0313087 A1 * 10/2016 Leasure ..... F41C 23/16
2017/0122684 A1 * 5/2017 Drake ..... F41A 11/02
2017/0122698 A1 5/2017 Chu
2017/0191791 A1 7/2017 Davis
2017/0299297 A1 * 10/2017 Scalf ..... F41A 11/02
2018/0066905 A1 * 3/2018 Battaglia ..... F41A 3/66
2019/0101345 A1 * 4/2019 Fellows ..... F41A 3/66

FOREIGN PATENT DOCUMENTS

DE 102006047959 B3 6/2008
EP 890816 A2 1/1999
EP 1026472 A2 8/2000
EP 1026472 A3 4/2001
EP 1674816 A1 6/2006
EP 1688696 A1 8/2006
EP 1756508 A1 2/2007
EP 1975541 A2 10/2008
EP 2198235 A1 6/2010
EP 2541188 A1 1/2013
EP 3163248 A1 5/2017
GB 754040 A 8/1956
GB 2332039 A 6/1999
GB 2346203 A 8/2000
GB 2382123 A 5/2003
JP 11118392 A 4/1999
RU 2077016 C1 4/1997
RU 2329450 C2 1/2006

(56) References Cited

FOREIGN PATENT DOCUMENTS

| | | | |
|---|---|---|---|
| RU | 2543139 | C1 | 2/2015 |
| WO | 2015034410 | A1 | 3/2015 |
| WO | 2015066590 | A2 | 5/2015 |

OTHER PUBLICATIONS

Accuracy International, "Accuracy International at Rifle System", "Retrieved from http://www.accuracyinternational.us/at-rifle-system/", May 15, 2017.
Accuracy International, "AX Rifle Systems", "Retrieved from http://www.accuracyinternational.us/ax-rifle-systems/", May 15, 2017.
Athlon Outdoors, "Accurate-Mags AM40A6 .308 Delivers Sub-Moa Precision", Feb. 18, 2016, Publisher: Retrieved from https://www.tactical-life.com/firearms/accurate-mags-am40a6-308-delivers-sub-moa-precision/#accurate-mag-am40a6-trigger.
Monveldt, Sergey, "File History Re U.S. Appl. No. 14/284,376", filed Aug. 20, 2015, p. 48.
Armlist, LLC, "Mcrees Precision G5 R7ST Chassis", "Retrieved from http://www.armslist.com/posts/5191383/wyoming-gun-parts-for-sale-mcrees-precision-g5-r7st-chassis", May 15, 2017.
Eberlestock, "Stealth Rifle Chassis", "Retrieved from http://www.eberlestock.com/store/stealth-rifle-chassis", Feb. 8, 2016, p. 2.
J. Allen Enterprises, "JAE-700 Standard Colors / Pricing", "Retrieved from http://www.jallenglobal.com/rife-stocks/jae-700/jae-700-standard-orders/", May 15, 2017.
Kinetic Research Group, LLC, "KRG Whiskey-3 Chassis", "Retrieved from https://kineticresearchgroup.com/product/whiskey-3-chassis/", May 15, 2017.
Coker Tactical, LLC, "KRG Whiskey 3 Chassis Stock Review", "Retrieved from https://tacticalgunreview.com/krg-whiskey-3-chassis-stock-review/", Apr. 7, 2014, p. 3.
Kinetic Research Group, LLC, "KRG X-Ray Chassis", "Retrieved from https://kineticresearchgroup.com/product/x-ray-chassis/", May 15, 2017.
Mcrees Precision, "Mcree's Precision G7 Rifle Stock Series", "Retrieved from http://shop.mcreesprecision.net/G7-RIFLE-STOCKS_c478.htm", May 15, 2017.
Mcree's Precision, "Mcree'S Precision G10 Rifle Stock Series", "Retrieved from http://shop.mcreesprecision.net/G10-RIFLE-STOCKS_c490.htm", May 15, 2017.
Clement, Michelle Renee, "Prosecution History Re U.S. Appl. No. 12/541,806", filed Sep. 17, 2010, p. 73.
Recoil Magazine, "Preview Mcree G5 TMAG", "Retrieved from http://www.recoilweb.com/preview-mcree-g5-tmag-1000-yards-no-problem-29765.html", May 15, 2017.
Remington Arms Company, Inc., "Sniper Rifles MSR", "Retrieved from http://remingtonmilitary.com/Firearms/Sniper%20Rifles/MSR.aspx", May 15, 2017.
Sako, LTD., "Sako TRG", "Retrieved from http://www.sako.fi/rifles/sako-trg#rifles", May 15, 2017.
Soldier Systems, "Posts Tagged SIG Sauer", "Retrieved from http://soldiersystems.net/tag/sig-sauer/page/5/", Feb. 18, 2016, p. 20.
XLR Industries, "Evolution Chassis Package", "Retrieved from https://xlrindustries.com/collections/chassis/products/evolution-chassis", May 15, 2017.
Kasten, Klaus, "Extended European Search Report Regarding Application No. 18196274.7", dated Mar. 19, 2019, pp. 7 Published in: EP.

* cited by examiner

INTERCHANGEABLE PLATES FOR A FIREARM

CLAIM OF PRIORITY UNDER 35 U.S.C. § 120

The present Application for Patent is a Continuation of patent application Ser. No. 15/824,161 entitled "INTERCHANGEABLE PLATES FOR A FIREARM" filed Nov. 28, 2017, pending, and assigned to the assignee hereof and hereby expressly incorporated by reference herein.

BACKGROUND

Field

The present invention relates generally to firearms, and more specifically to accommodations for a bolt handle.

Background

In the course of manufacturing firearm, historically, manufacturers have generally provided firearms and components suited for right-handed users. Left-handed users are generally required to special order firearms or components suitable for use. However, as much as 10% of the population is left-handed, meaning that a substantial portion of the population whose needs are only met through special-order components. Moreover, users, particularly those in the after-market components industry, desire that firearms have as much versatility and usability as possible. There is therefore a need for a firearm that increases versatility and provides greater access to left-handed users.

SUMMARY

An exemplary firearm has a chassis, a stock portion coupled to the chassis, and a pair of interchangeable plates removably coupled to the chassis. Each of the exemplary pair of interchangeable plates is attachable to the chassis at a first location and a second location opposing the first location. A first one of the exemplary pair of interchangeable plates has a recess for receiving a portion of a bolt handle. A second one of the exemplary pair of interchangeable plates has a firearm tool interface.

An exemplary method includes providing a firearm having a bolt handle, a chassis, and a stock portion coupled to the chassis. The exemplary method includes providing a pair of reversible plates, wherein a first one of the pair of reversible plates has a recess for receiving a portion of the bolt handle, and a second one of the pair of reversible plates has a firearm tool interface. The exemplary method includes removably coupling the first one of the pair of reversible plates to the chassis at a first location, and removably coupling the second one of the pair reversible plates to the chassis at a second location opposing the first location.

DETAILED DESCRIPTION

The word "exemplary" is used herein to mean "serving as an example, instance, or illustration." Any embodiment described herein as "exemplary" is not necessarily to be construed as preferred or advantageous over other embodiments. For the purpose of this document, the term "distal" shall refer to a direction or side associated with a firing direction of a firearm. The term "proximal" shall refer to a direction or side associated with a side or direction opposing the firing direction or distal side.

Figure 1:
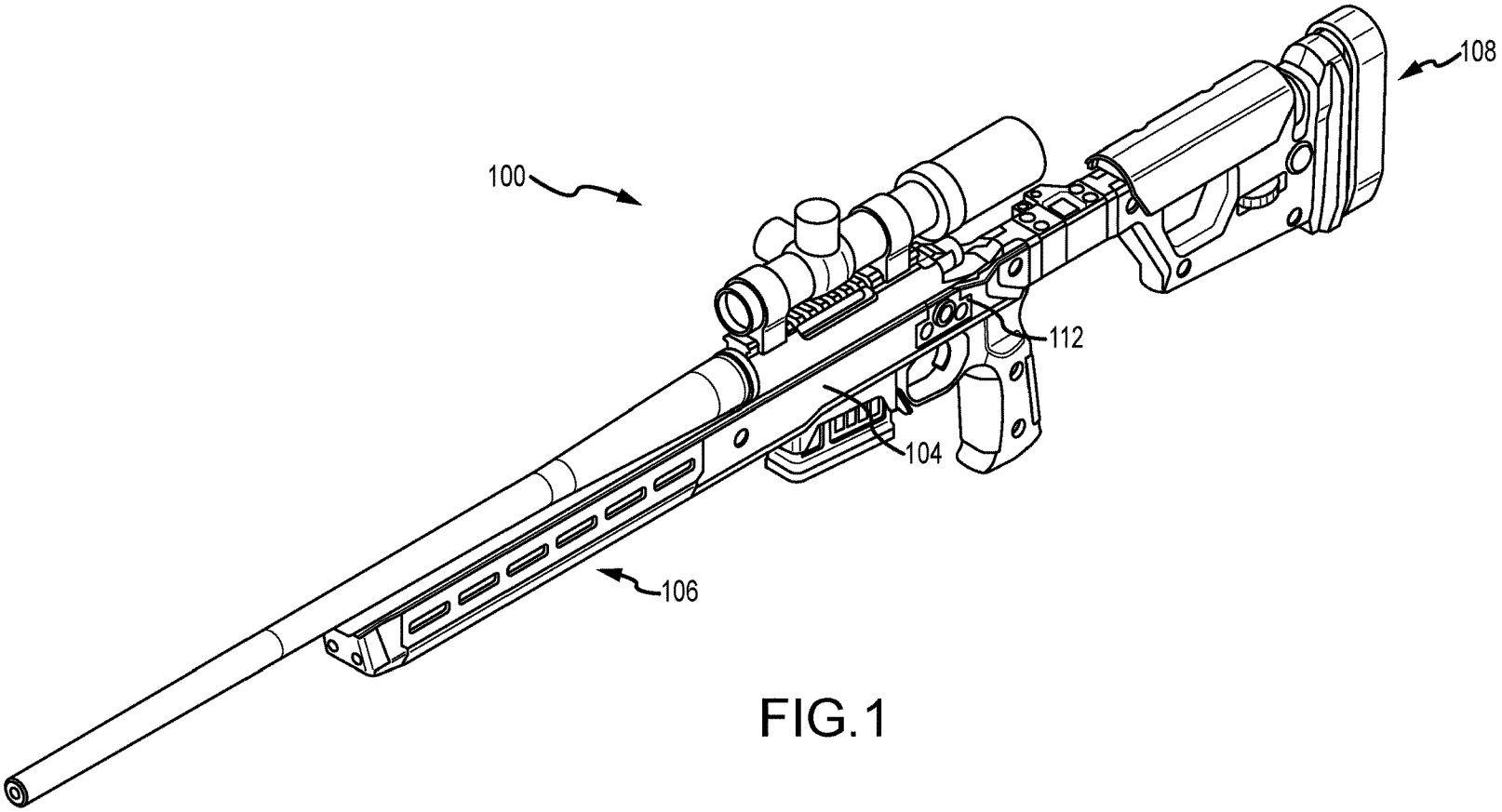
FIG. 1 is a perspective view of a firearm.
Figure 2:
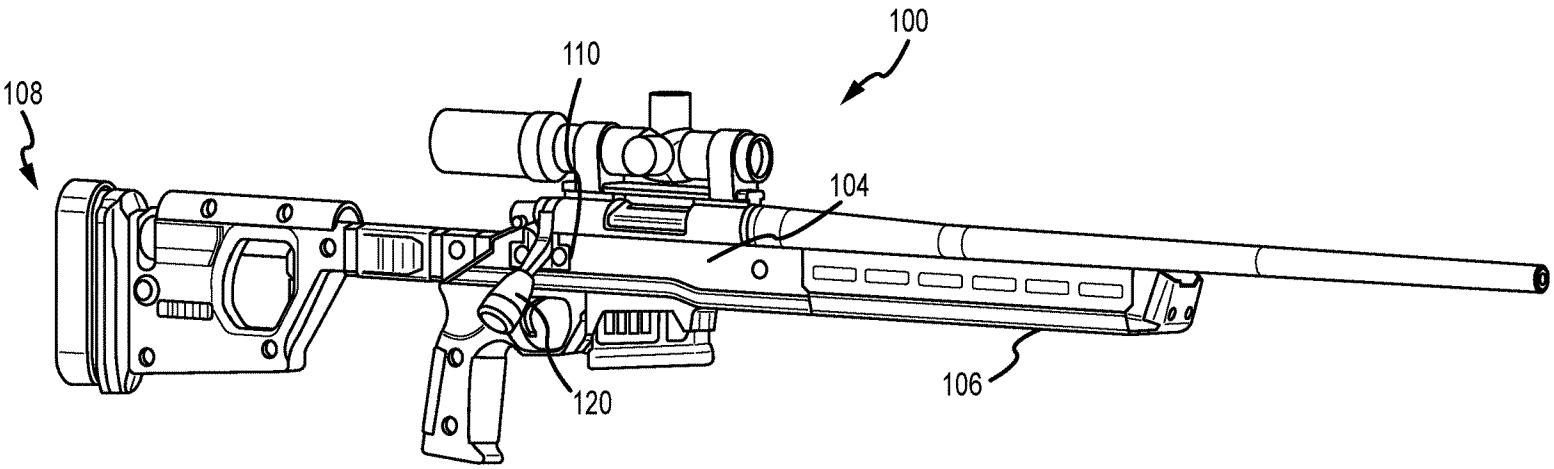
FIG. 2 is a second perspective view of the firearm in FIG. 1.
Figure 3:
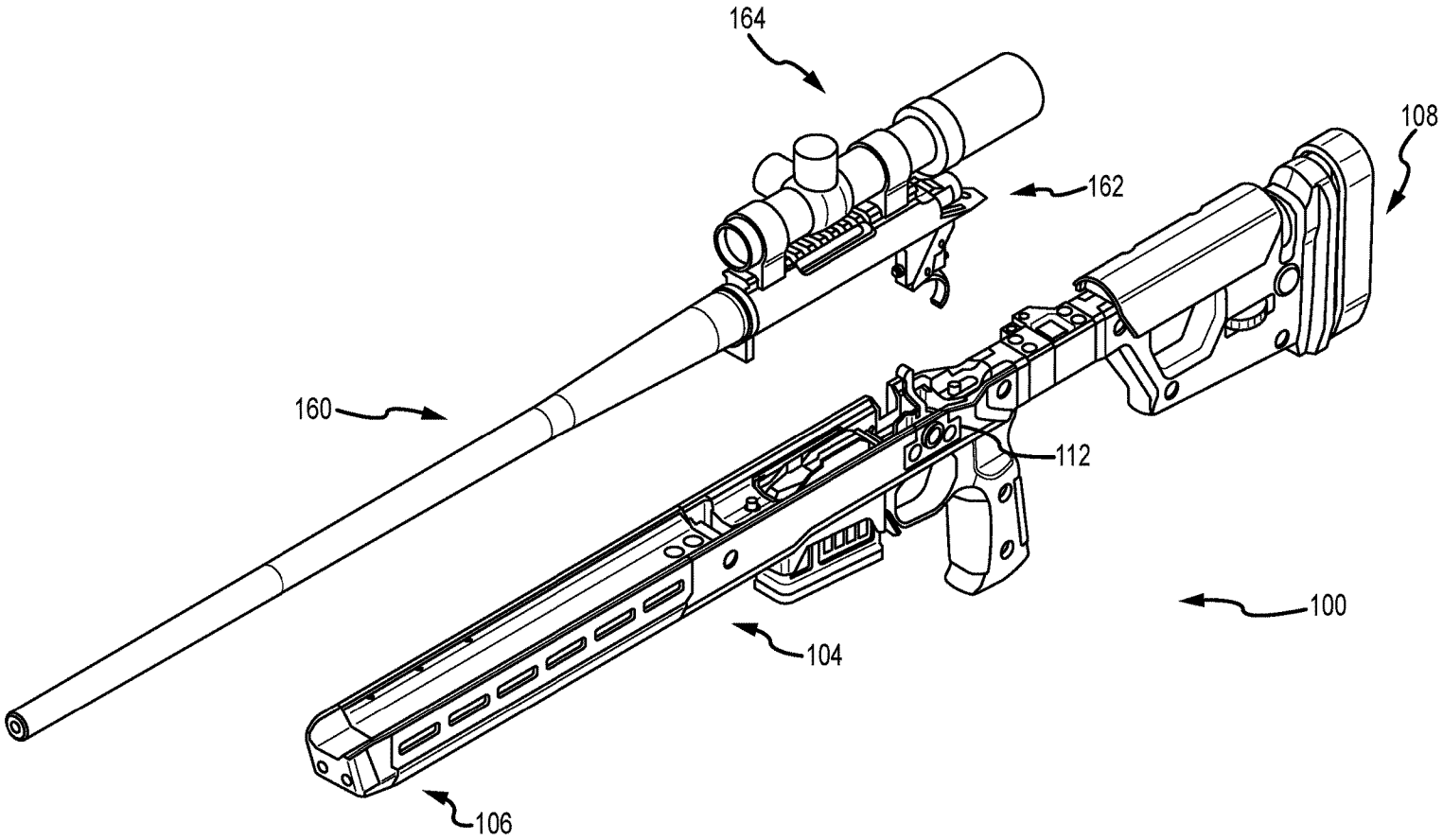
FIG. 3 is a partial exploded perspective view of the firearm in FIG. 1 with components.

As previously indicated, current firearms are generally provided by the manufacturer as either being left-handed or right-handed. However, those in the after-market components industry seek greater versatility in both the ability to meet the needs for left- and right-handed users, as well as to provide a firearm that has increased user features. The Applicant meets these needs by providing a firearm 100 with a pair of reversible plates 100, 112, to accommodate either a right-handed bolt 120 as illustrated in FIG. 1 or a left-handed bolt (not illustrated). Additionally, one of the plates 112 is provided with a tool interface 122. Where the tool interface 122 includes a QD socket 122, the user is provided with the ability to carry the firearm 100 at a point that is near—but proximal of—the center of gravity of the firearm, thus ensuring the firearm 100 is pointed downward during transport but high enough that the firearm 100 is maintained at an ideal carrying height. That is, the location of the plates 100, 112 provides a dual function.

With reference now to FIGS. 1-4, an exemplary firearm 100 is described. The firearm 100 may have a chassis 102 (see e.g. FIG. 4) and a stock portion 104 coupled to or configured to be coupled to the chassis 102. The stock portion 104 may have a forend 106 associated with a distal portion of the firearm 100, and/or a buttstock portion 108 associated with a proximal end of the firearm 100. A pair of reversible plates 110, 112 may be removably coupled to the chassis 102, each of the pair of reversible plates 110, 112 attachable to the chassis 102 at a first location 114 and a second location 116 opposing the first location 114. The locations 114, 116 may be proximal of a center of gravity of the firearm 100. As most clearly illustrated in FIG. 3, the firearm 100 may include a barrel 160, a receiver portion 162, and/or a scope 164 or other tool.

Figure 6:
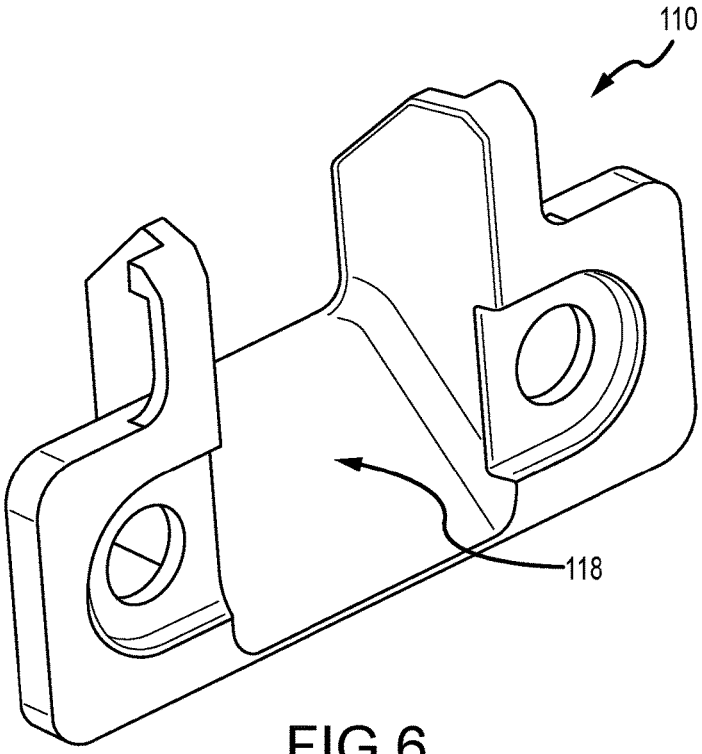
FIG. 6 is a perspective view of a first plate used in the firearm in FIG. 1.
Figure 7:
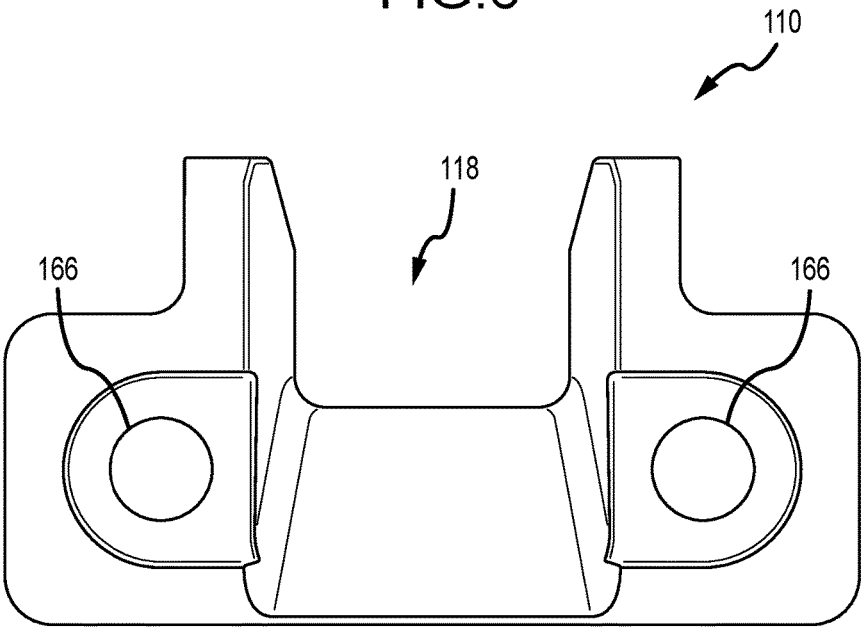
FIG. 7 is a front view of the plate in FIG. 6.
Figure 8:
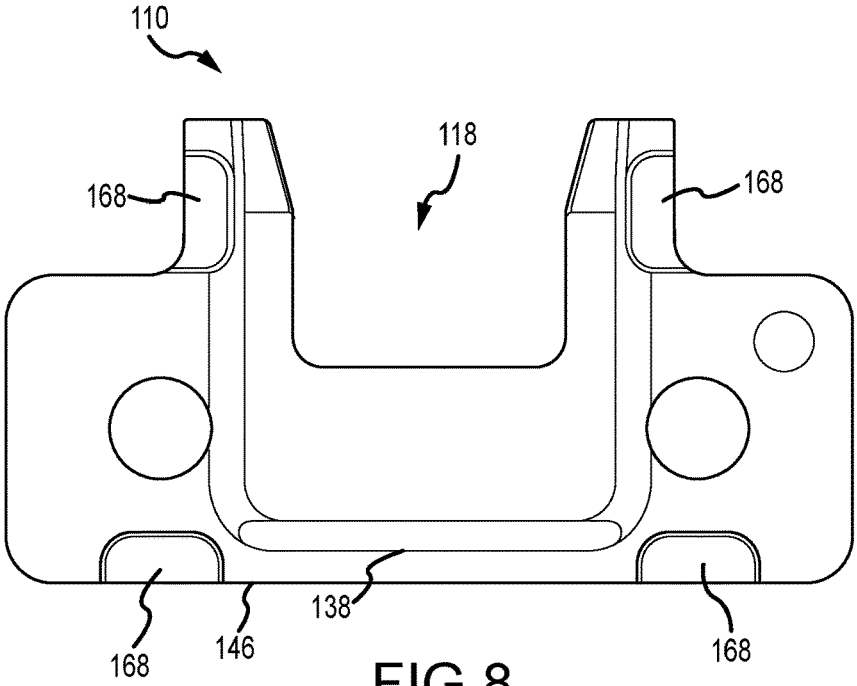
FIG. 8 is a rear view of the plate in FIG. 6.
Figure 9:
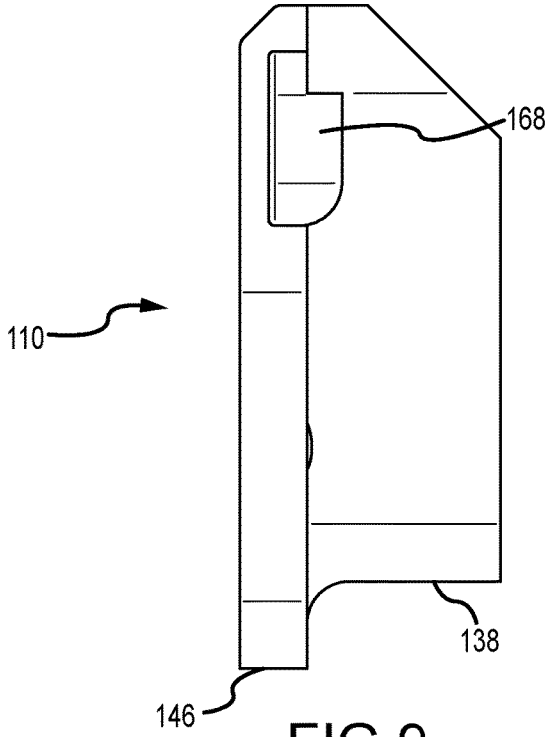
FIG. 9 is a right side view of the plate in FIG. 6.
Figure 10:
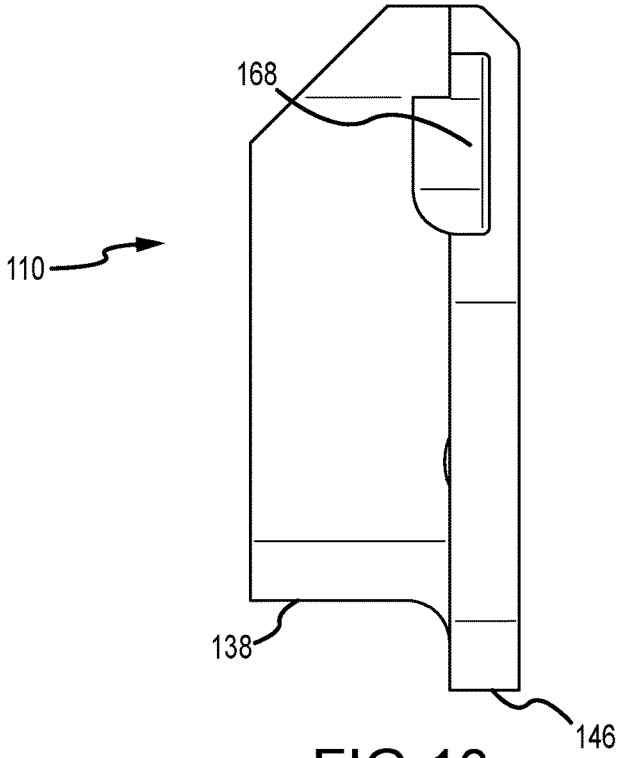
FIG. 10 is a left side view of the plate in FIG. 6.
Figure 11:
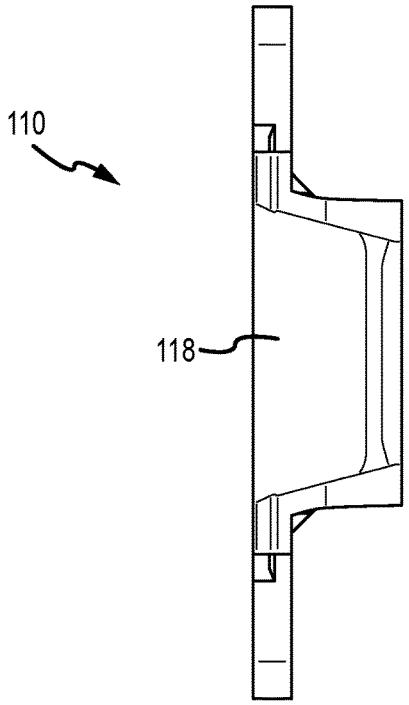
FIG. 11 is a top view of the plate in FIG. 6.
Figure 12:
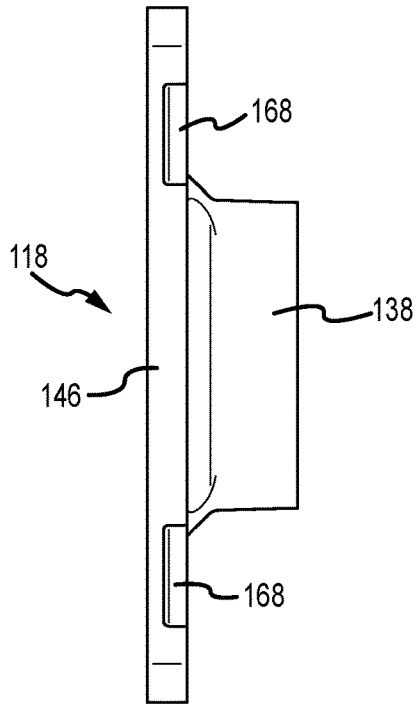
FIG. 12 is a bottom view of the plate in FIG. 6.
Figure 13:
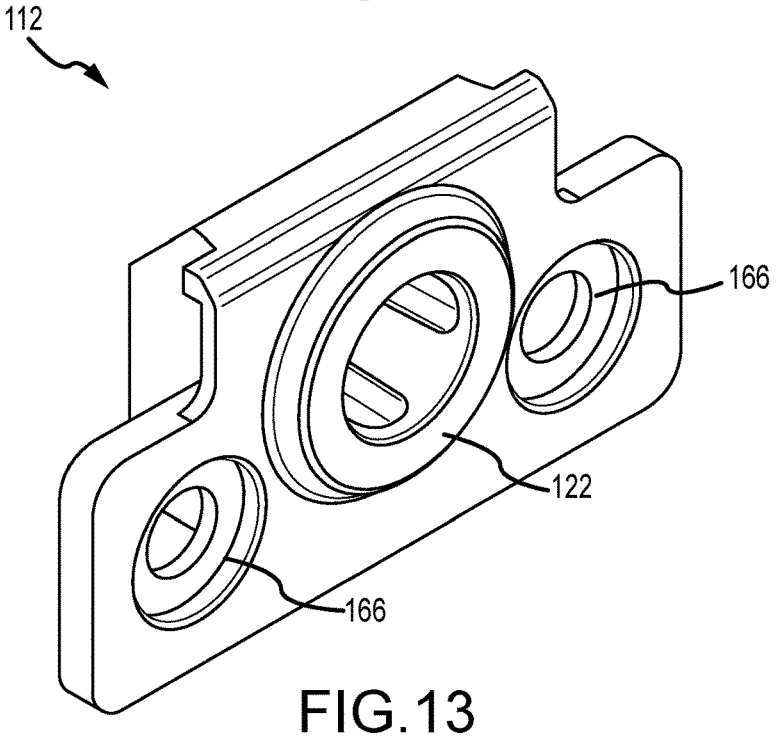
FIG. 13 is a perspective view of a second plate used in the firearm in FIG. 1.
Figure 14:
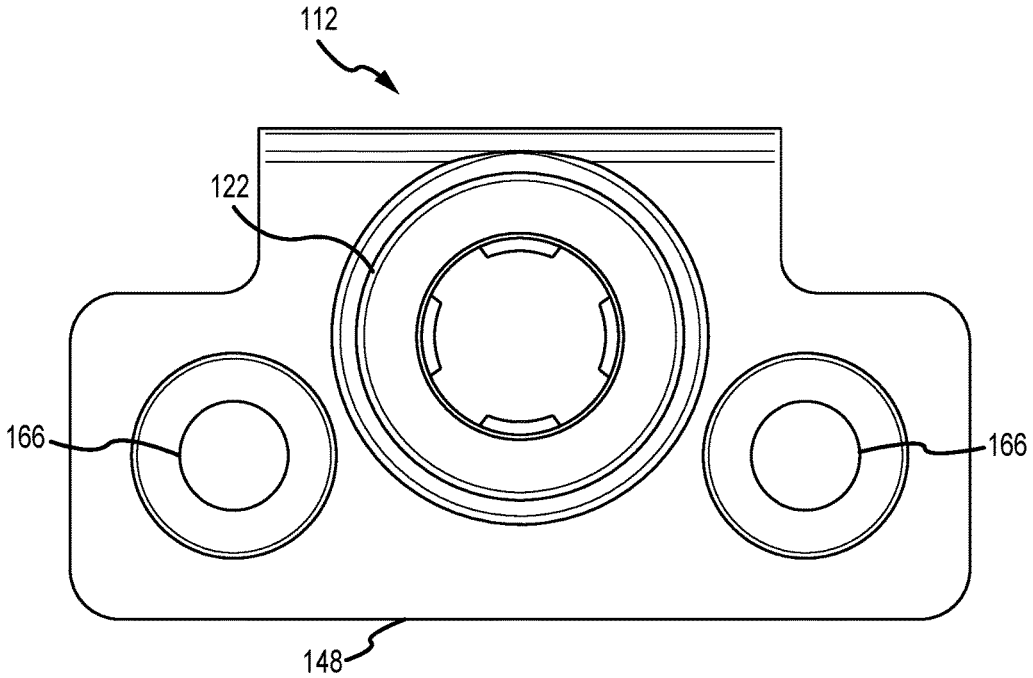
FIG. 14 is a front view of the plate in FIG. 13.
Figure 15:
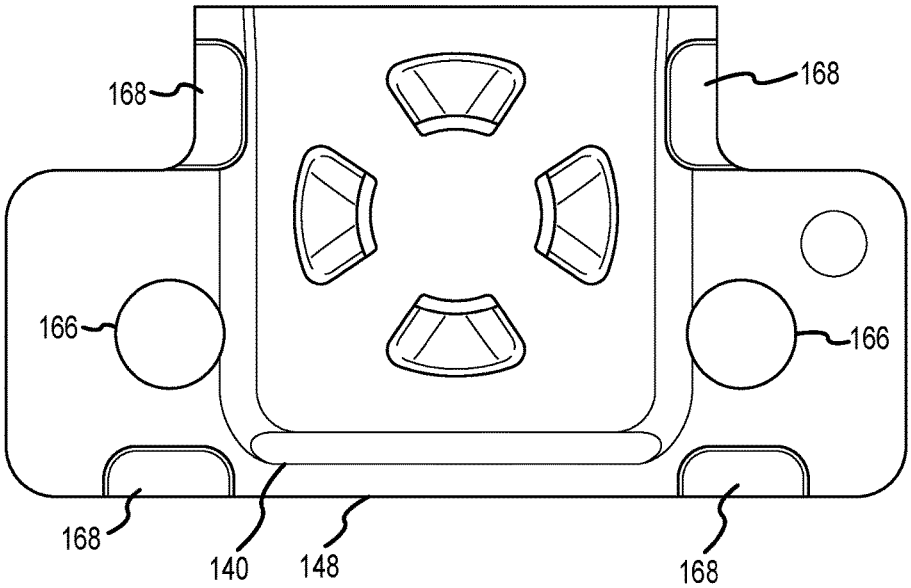
FIG. 15 is a rear view of the plate in FIG. 13.
Figure 16:
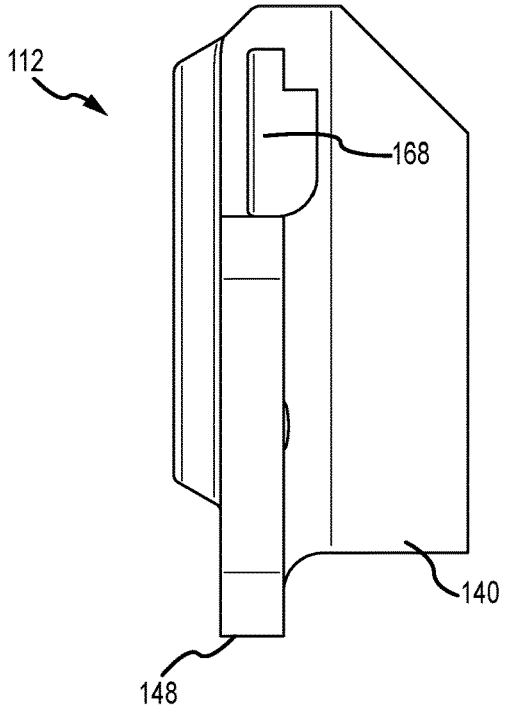
FIG. 16 is a right side view of the plate in FIG. 13.
Figure 17:
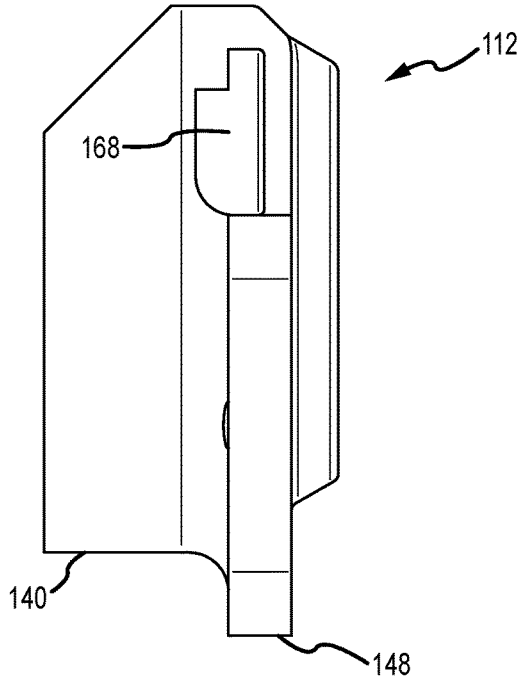
FIG. 17 is a left side view of the plate in FIG. 13.
Figure 18:
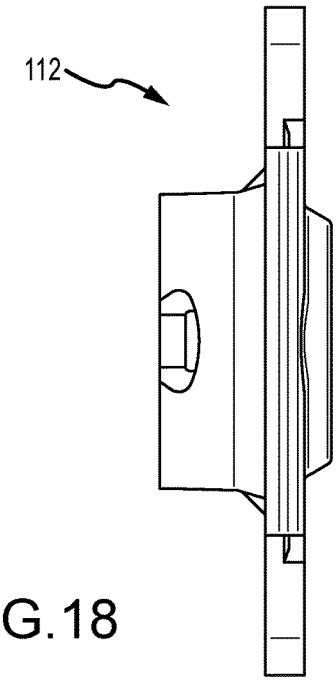
FIG. 18 is a top view of the plate in FIG. 13.
Figure 19:
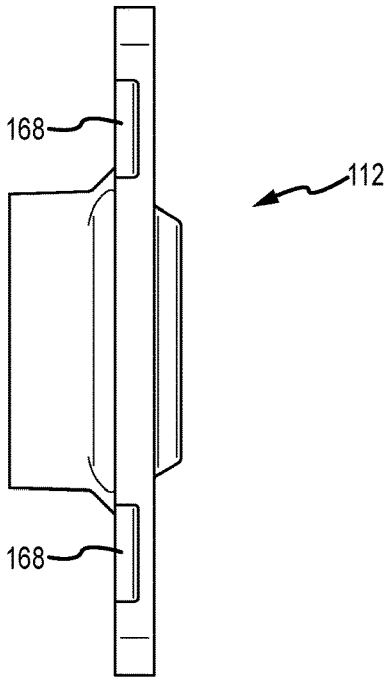
FIG. 19 is a bottom view of the plate in FIG. 13.

A first one of the pair of reversible plates 110 may have a recess 118 for receiving a portion of a bolt handle 120 (see e.g. FIG. 1 and FIG. 6). A second one of the pair of reversible plates 112 may have a firearm tool interface 122, as most clearly illustrated in FIG. 13. The firearm tool interface 122 may be a quick-disconnect (QD) socket 122.

Figure 4:
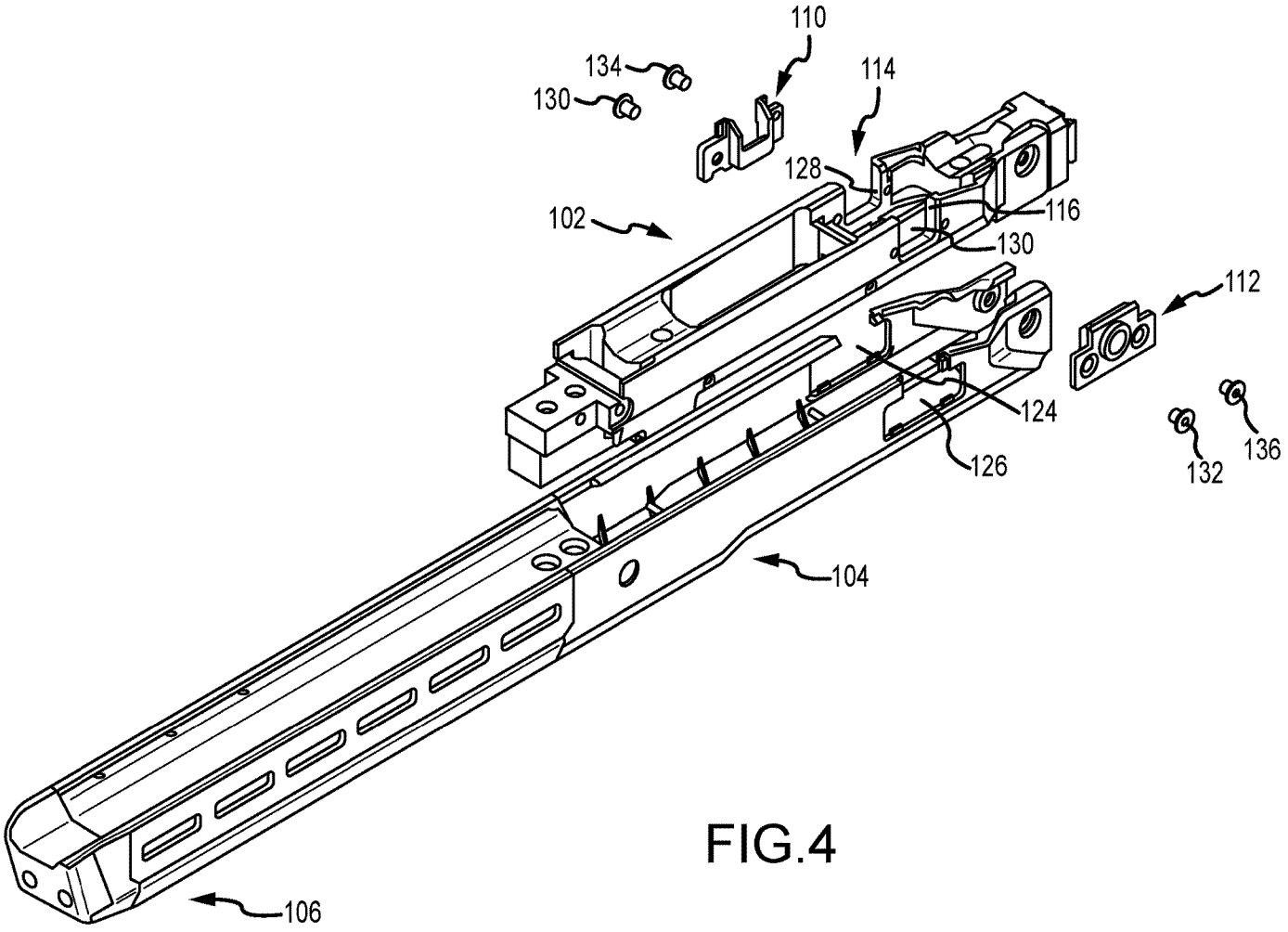
FIG. 4 is a perspective view of some components of the firearm in FIG. 1.
Figure 5:
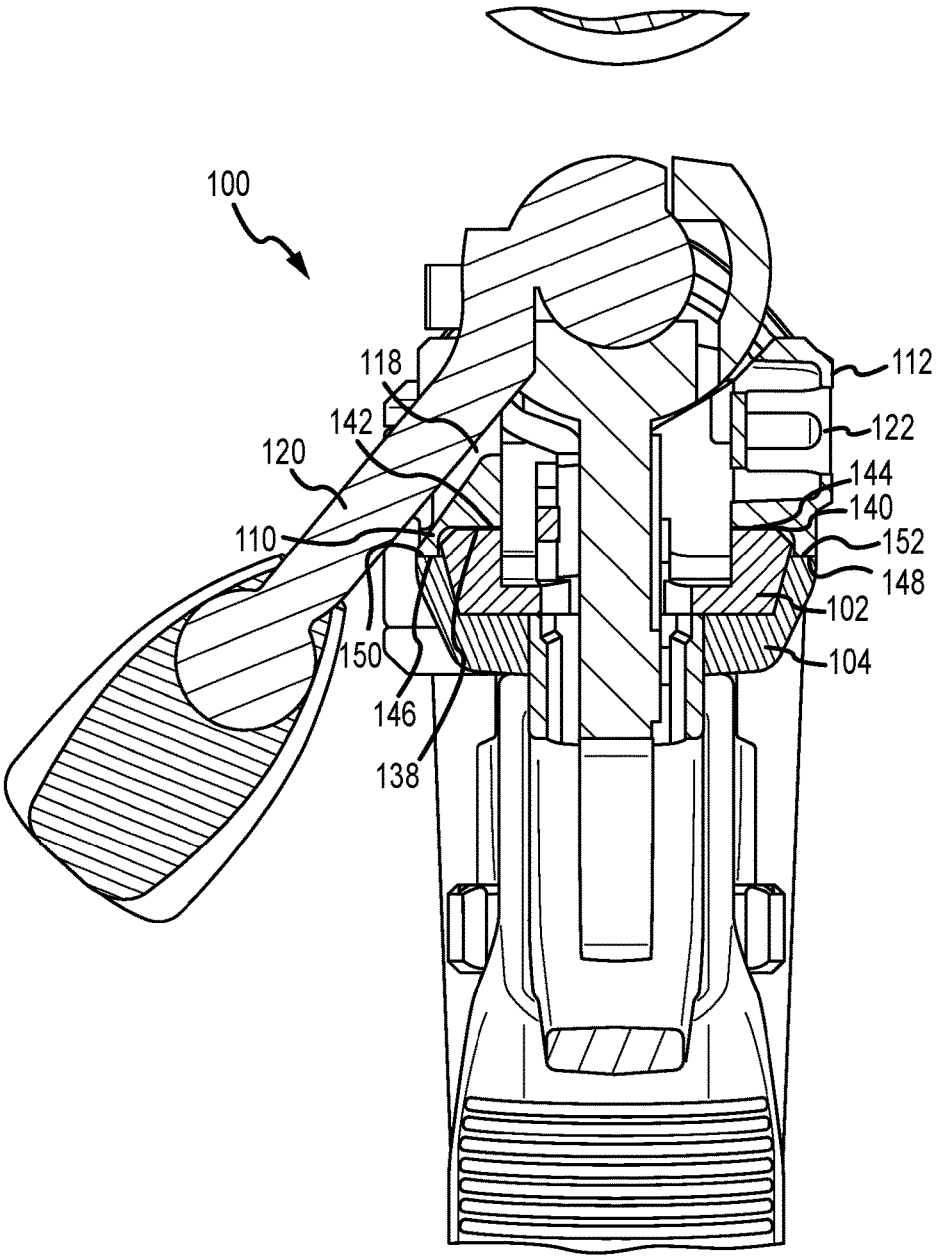
FIG. 5 is a section view illustrating details of components of the firearm in FIG. 1.

As illustrated most clearly in FIG. 5 in combination with FIG. 4, a portion of the first plate 110 may extend through a first recess 124 in the stock portion 104. Similarly, a portion of the second plate 112 may extend through a second recess 126 in the stock portion 104. Relatedly, a portion of the first plate 110 may extend through or into a first recess 128 in the chassis 102. Similarly, a portion of the second plate 112 may extend through or into a second recess 130 in the chassis 102. By having the plates 110, 112 extend into the chassis 102, the Applicant has provided an efficient and suitable means for securing the plates 110, 112, thereby expanding the potential uses of the plates 110, 112. For example, here, the plate 112 not used to receive the bolt handle 120 is configured with a tool interface 122, such as a QD socket 122, which normally would not be possible at the locations 114, 116 illustrated in FIG. 4. Moreover, the locations 114, 116 themselves provide simultaneously provide for the ability to interchange the plates 110, 112 so as to provide for the ability to use a left-hand bolt instead of the right-hand bolt 120 that is shown while also providing an ideal location for a tool interface 122 such as a QD socket 122. Specifically, the locations 114, 116 allow for a single mount sling attachment at a position that ensures the firearm 100 will point down but is also held high enough to maintain an ease of carrying.

As most clearly illustrated in FIG. 1 and FIG. 4, a first fastener 130 may be provided to couple the first plate 110 to the chassis 102, and a second fastener 132 may be provided to couple the second plate 112 to the chassis 102. Additional fasteners 134, 136 may be provided as needed to secure the plates 110, 112 to the chassis 102. The plates 110, 112 may each have one or more fastener receivers 166, such as apertures as illustrated.

As most clearly illustrated in FIG. 5, the first plate 110 and the second plate 112 may each have a flange surface 138, 140, respectively, for engaging respective flange surface 142, 144 on the chassis 102. This feature further improves the strength of the engagement between the plates 110, 112 and the chassis 102.

Relatedly, each of the plates 110, 112 may have a flange surface 146, 148 for engaging a corresponding flange surface 150, 152 on the stock portion 104. Here, the engagement between the flange surfaces 146, 148 in the plates and the flange surfaces 150, 152 in the stock portion 104 may primarily provide for an alignment feature between the plates 110, 112 and stock portion 104. As most clearly illustrated in FIGS. 8, 12, 15, and 19, the plates 110, 112 may have positioning slots 168 to assist in alignment of the plates 110, 112 with the stock portion 104, to improve the ease with which a user may attach the plates 110, 112. That is, the slots 168 may allow a user to generally position the plates 110, 112 and easily hold the plates 110, 112 while attaching using fasteners.

For detailed reference, FIGS. 6-12 illustrate various views of the first plate 110 previously described herein.

For detailed reference, FIGS. 13-19 illustrate various views of the second plate 112 previously described herein.

Figure 20:
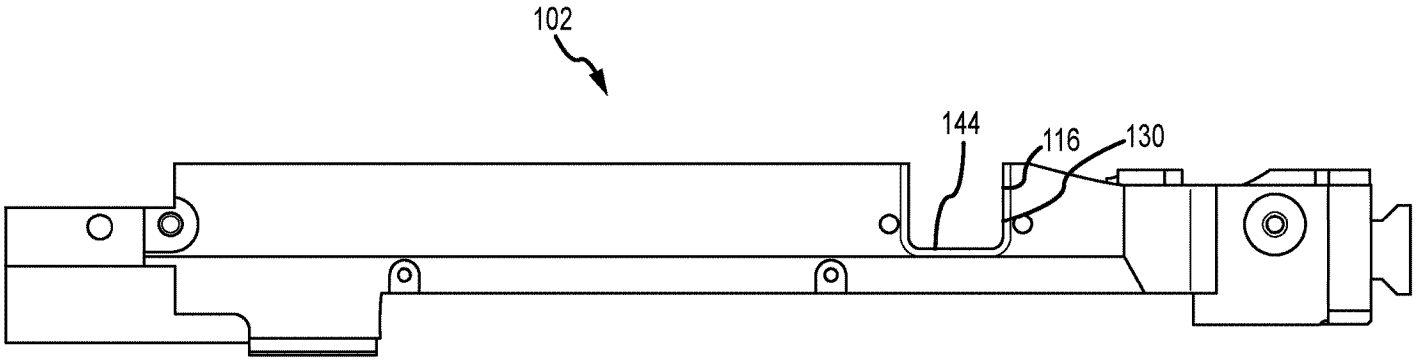
FIG. 20 is a right side view of a chassis used in the firearm in FIG. 1.
Figure 21:
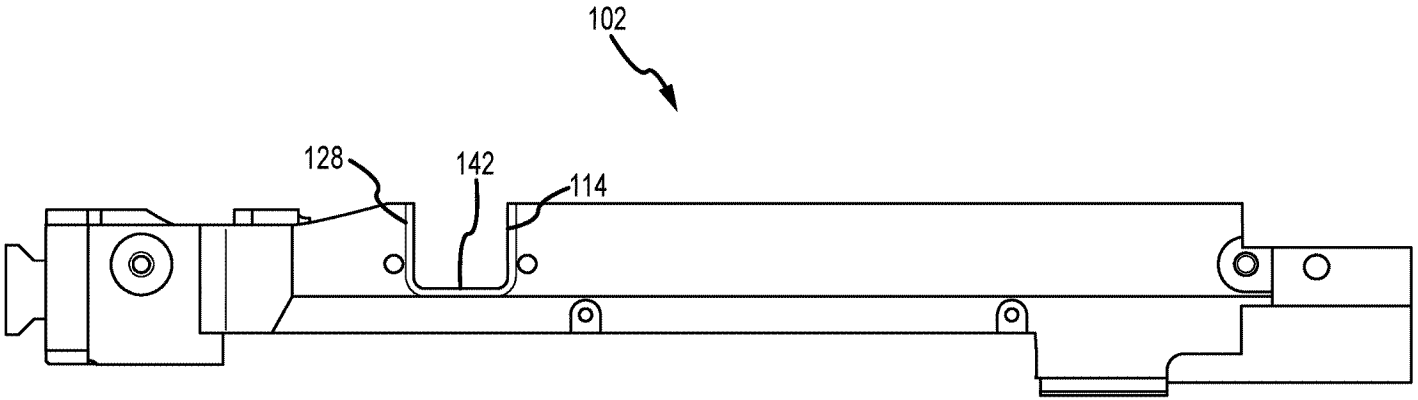
FIG. 21 is a left side view of the chassis in FIG. 20.
Figure 22:
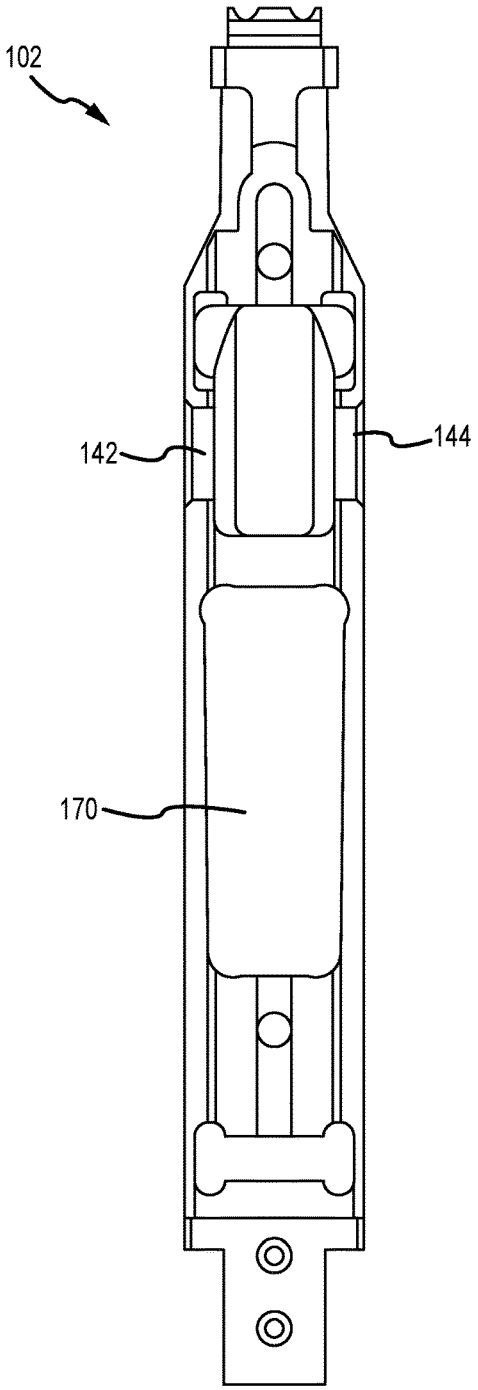
FIG. 22 is a top view of the chassis in FIG. 20.

For detailed reference, FIGS. 20-22 illustrate various views of the chassis 102 previously described herein. As illustrated most clearly in FIG. 22, the chassis 102 may include a magazine well 170.

Figure 23:
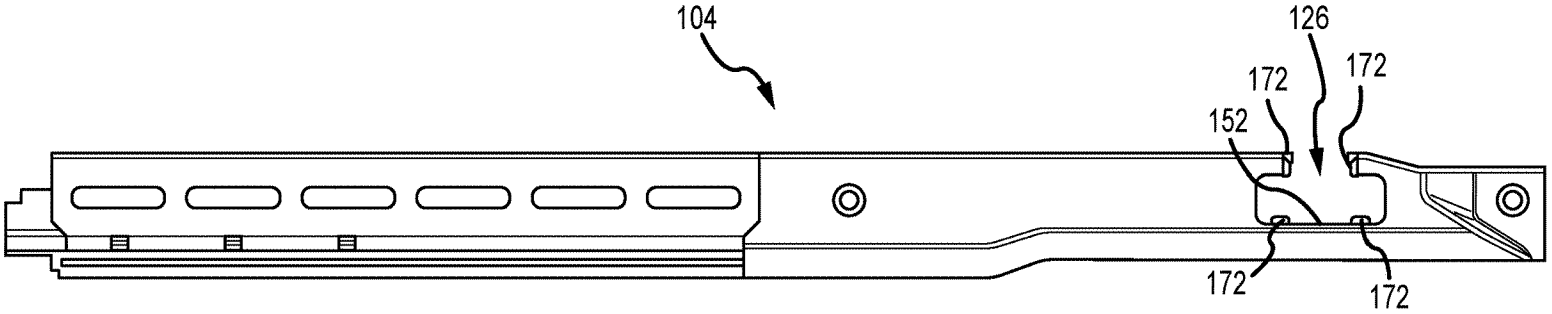
FIG. 23 is a right side view of a stock portion used in the firearm in FIG. 1.
Figure 24:
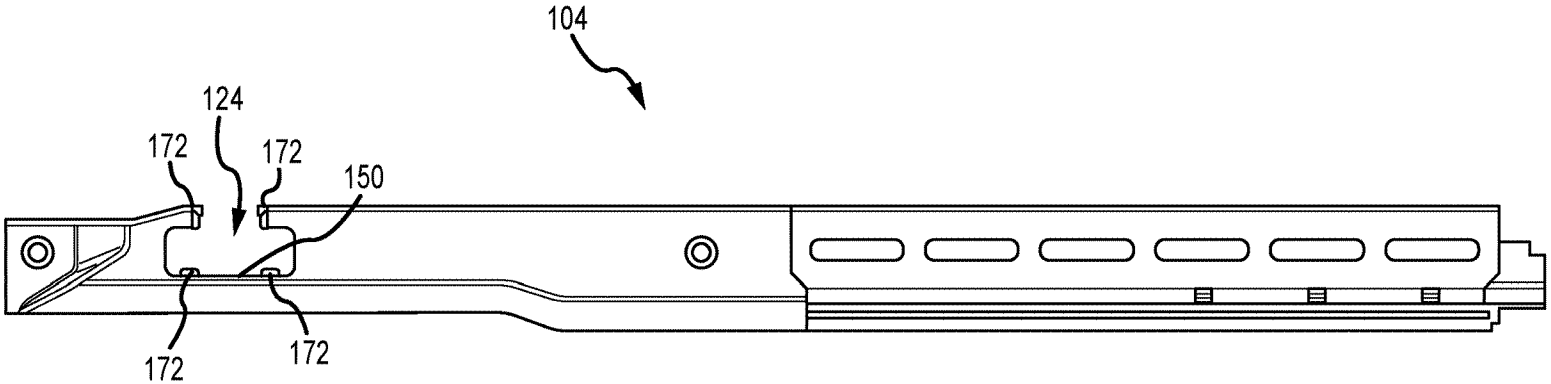
FIG. 24 is a left side view of the stock portion in FIG. 23.
Figure 25:
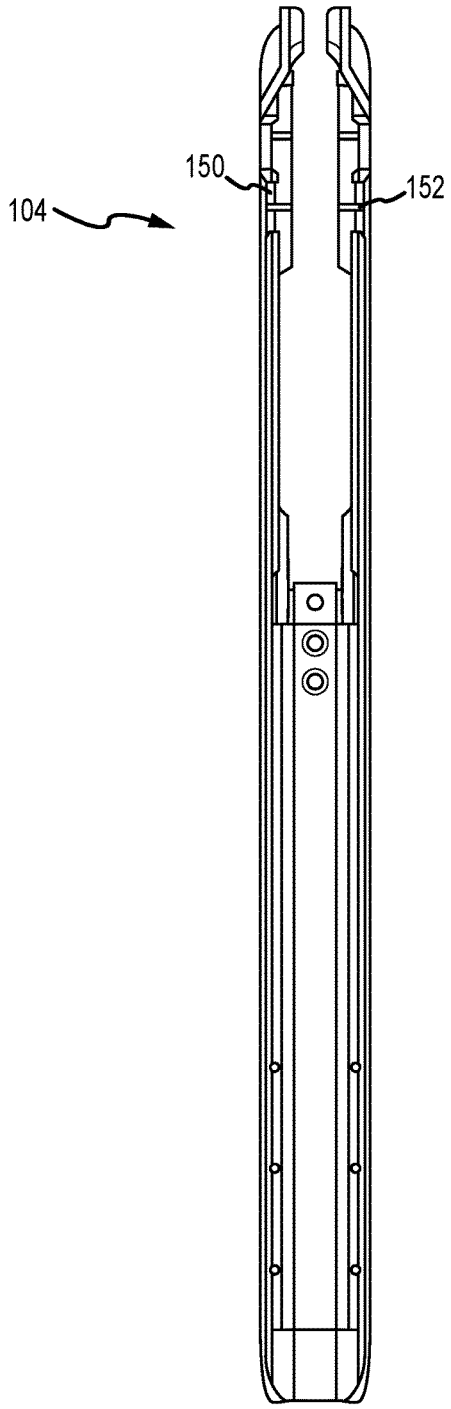
FIG. 25 is a top view of the stock portion in FIG. 23.

For detailed reference, FIGS. 23-25 illustrate various views of the stock portion 104 previously described herein. As illustrated most clearly in FIGS. 23-24, the stock portion 104 may have one or more tabs or protrusions 172 shaped and positioned to engage the slots 168 in the plates 110, 112 for assisting in aligning the plates 110, 112.

Figure 26:
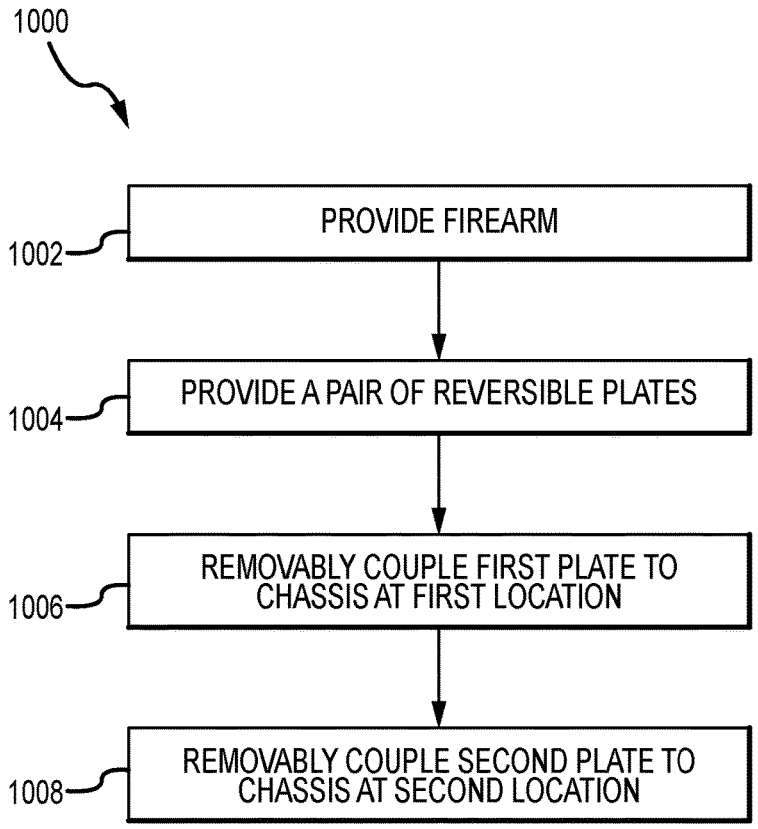
FIG. 26 is a flowchart of a method.

Turning now to FIG. 26, a method 1000 is described. The method 1000 may be performed using the components previously described herein. The method 1000 may include providing 1002 a firearm having bolt handle, a chassis, and a stock portion coupled to the chassis. The method 1000 may include providing 1004 a pair of reversible plates, wherein a first one of the pair of reversible plates has a recess for receiving a portion of the bolt handle, and a second one of the pair of reversible plates has a firearm tool interface. The method 1000 may include removably coupling 1006 the first one of the pair of reversible plates to the chassis at a first location, and/or removably coupling the second one of the pair reversible plates to the chassis at a second location opposing the first location.

The firearm tool interface may be a quick-disconnect socket.

The method 1000 may include passing a portion of the first plate through a first recess in the stock portion, and/or passing a portion of the second plate through a second recess in the stock portion.

The method 1000 may include causing a portion of each of the pair of reversible plates to protrude into respective first and second recesses in the chassis.

The method 1000 may include using a first fastener to couple the first plate to the chassis, and/or using a second fastener to couple the second plate to the chassis.

The method 1000 may include causing a flange surface in each of the plates to engage a respective flange surface on the chassis, whereby the pair of reversible plates are supported by the chassis.

The method 1000 may include causing a flange surface in each of the plates to engage a respective flange surface on the stock portion, whereby the pair of reversible plates are positioned by the stock portion.

The method 1000 may include detaching the reversible plates from the chassis, removably coupling the first plate to the chassis at the second location, removably coupling the second plate to the chassis at the first location.

The method 1000 may include moving a portion of a bolt handle into the recess of the first one of the pair of reversible plates.

The terms and expressions employed herein are used as terms and expressions of description and not of limitation, and there is no intention, in the use of such terms and expressions, of excluding any equivalents of the features shown and described or portions thereof. Each of the various elements disclosed herein may be achieved in a variety of manners. This disclosure should be understood to encompass each such variation, be it a variation of an embodiment of any apparatus embodiment, a method or process embodiment, or even merely a variation of any element of these. Particularly, it should be understood that the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled.

As but one example, it should be understood that all action may be expressed as a means for taking that action or as an element which causes that action. Similarly, each physical element disclosed should be understood to encompass a disclosure of the action which that physical element facilitates. Regarding this last aspect, by way of example only, the disclosure of a "protrusion" should be understood to encompass disclosure of the act of "protruding"—whether explicitly discussed or not—and, conversely, were there only disclosure of the act of "protruding", such a disclosure should be understood to encompass disclosure of a "protrusion". Such changes and alternative terms are to be understood to be explicitly included in the description.

The previous description of the disclosed embodiments and examples is provided to enable any person skilled in the art to make or use the present invention as defined by the claims. Thus, the present invention is not intended to be limited to the examples disclosed herein. Various modifications to these embodiments will be readily apparent to those skilled in the art, and the generic principles defined herein may be applied to other embodiments without departing from the spirit or scope of the invention as claimed.

What is claimed is:

1. A firearm accessory mount interface, comprising:

a pair of interchangeable plates configured for removable coupling to a chassis of a firearm, each of the pair of interchangeable plates configured for attachment to the chassis at a first location and a second location opposing the first location; wherein a first one of the pair of interchangeable plates comprises a recess configured for receiving a portion of a bolt handle of a firearm; and a second one of the pair of interchangeable plates comprises a firearm tool interface; wherein a portion of the first plate is shaped to extend into a first recess in the chassis;

a portion of the second plate is shaped to extend into a second recess in the chassis; and each of the first plate and the second plate include at least one fastener receiver shaped to accept a respective fastener, each of the fasteners configured to couple the plates to the chassis.

2. The firearm accessory mount interface of claim 1, wherein:

the firearm tool interface is a quick-disconnect socket.

3. The firearm accessory mount interface of claim 1, wherein:

a portion of the first one of the pair of interchangeable plates is configured to extend through a first recess in a stock of the firearm; and a portion of the second one of the pair of interchangeable plates is configured to extend through a second recess in the stock of the firearm.

4. The firearm accessory mount interface of claim 1, wherein:

each of the first one and second one of the pair of interchangeable plates comprises a flange surface for engaging a corresponding flange surface on the chassis.

5. The firearm accessory mount interface of claim 1, wherein:

each of the first one and second one of the pair of interchangeable plates comprises a flange surface for engaging a corresponding flange surface on a stock of the firearm.

6. A system, comprising:

a pair of interchangeable plates configured for removable coupling to a chassis of a firearm, each of the pair of interchangeable plates configured for attachment to the chassis at a first location and a second location opposing the first location; wherein a first one of the pair of interchangeable plates comprises a recess configured for receiving a portion of a bolt handle of the firearm; and a second one of the pair of interchangeable plates comprises a firearm tool interface; wherein a portion of the first plate is shaped to extend through at least a recess in a stock of the firearm;

a portion of the second plate is shaped to extend through at least the recess in the stock of the firearm; and each of the first plate and the second plate include at least one fastener receiver shaped to accept a respective fastener, each of the fasteners configured to couple the plates to the chassis.

7. The system of claim 6, wherein:

the firearm tool interface is a quick-disconnect socket.

8. The system of claim 6, wherein:

each of the first one and second one of the pair of interchangeable plates comprises a flange surface for engaging a corresponding flange surface on the chassis.

9. The system of claim 6, wherein:

each of the first one and second one of the pair of interchangeable plates comprises a flange surface for engaging a corresponding flange surface on the stock.

10. A firearm, comprising:

a chassis having a first recess and a second recess arranged in opposing locations;

a stock coupled to the chassis and having a third and a fourth recess arranged in opposing locations and aligned with the first and second recesses, the third and fourth recesses being wider than the first and second recesses; and a pair of interchangeable plates configured for removable coupling to the chassis;

wherein a first one of the pair of interchangeable plates comprises a recess configured for receiving a portion of a bolt handle of the firearm; and wherein a portion of the first plate is shaped to extend into the first recess in the chassis;

a portion of a second one of the pair of interchangeable plates is shaped to extend into the second recess in the chassis.

11. The firearm of claim 10, wherein:

the accessory mount is a quick-disconnect socket.

12. The firearm of claim 10, wherein:

each of the first one and second one of the pair of interchangeable plates comprises a flange surface that engages a corresponding flange surface on the chassis.

13. The firearm of claim 10, wherein:

each of the first one and second one of the pair of interchangeable plates comprises a flange surface that engages a corresponding flange surface on the stock.

14. The firearm of claim 10, further comprising:

each of the first plate and the second plate include at least one fastener receiver shaped to accept a respective fastener, each of the fasteners coupling one of the pair of interchangeable plates to the chassis.

15. The firearm of claim 10, wherein:

the second one of the pair of interchangeable plates comprises an accessory mount.

* * * * *